United States Patent [19]

Gardner

[11] Patent Number: 4,674,185

[45] Date of Patent: Jun. 23, 1987

[54] PLANER ATTACHMENT FOR CHAIN SAWS

[76] Inventor: Douglas S. Gardner, 427 Peters Rd., Randle, Wash. 98377

[21] Appl. No.: 884,073

[22] Filed: Jul. 10, 1986

[51] Int. Cl.[4] ..... B27B 17/02; B27C 1/10

[52] U.S. Cl. ..... 30/122; 30/475; 144/117 C

[58] Field of Search ..... 30/476, 477, 475, 122; 144/117 C; 83/790

[56] References Cited

U.S. PATENT DOCUMENTS

| | | | |
|---|---|---|---|
| 1,139,383 | 5/1915 | Svendsen | 30/476 |
| 1,758,029 | 5/1930 | Cole | 30/476 |
| 2,562,832 | 7/1951 | Strandberg . | |
| 2,600,859 | 6/1952 | Drysdale | 30/475 |
| 2,675,034 | 4/1954 | Ledding | 30/476 X |
| 2,708,468 | 5/1955 | Lantz | 83/790 X |
| 2,783,794 | 3/1957 | Kroll | 83/790 X |
| 2,810,409 | 10/1957 | Ibelle et al. . | |
| 2,889,860 | 6/1959 | Bagley | 144/117 C |
| 3,207,195 | 9/1965 | Anton | 144/117 C |
| 3,407,857 | 10/1968 | Bentley . | |
| 4,304,275 | 12/1981 | Glover | 30/371 |
| 4,433,710 | 2/1984 | Posta | 30/475 |
| 4,479,303 | 10/1984 | Gardner | 30/383 |
| 4,506,444 | 3/1985 | Sundström | 30/122 |
| 4,603,715 | 8/1986 | Muehlhauer | 30/122 |

*Primary Examiner*—Jimmy C. Peters

*Attorney, Agent, or Firm*—John O. Graybeal

[57] ABSTRACT

A chain saw attachment for a portable chain saw. The chain saw attachment comprises a cutter head journalled on the cutter axle and having four planing knives, two mounting arms removably securable to the chain saw bar, a chain sprocket engaging and being rotated by the saw chain, a driving sprocket rotated in response to rotation of the chain sprocket, a driven sprocket fixedly attached to the cutter head, and a planer chain engaged by the driving and driven sprockets so as to transmit power from the saw motor to the cutter head. The planing knives are arranged conventionally on the cutter head. The mounting arms the ends of the cutter axle so as to hold the cutter axle and cutter head perpendicularly to the saw bar. A planing guide is provided for use with the planer attachment. The planing guide has two side members, and forward and rearward guide members affixed to and respectively positioned forwardly and rearwardly along the side members so as to define a cutting plane determining the depth of cut of the planing knives. Vertical slots in the side members pivotably mount the planing guide on the ends of the cutter axle and allow the planing guide to be positioned vertically with respect to the cutter axle, thus providing a precise depth adjustment mechanism for maintaining a selected depth of cut.

16 Claims, 4 Drawing Figures

PLANER ATTACHMENT FOR CHAIN SAWS

BACKGROUND OF THE INVENTION

1. Technical Field

This invention relates to attachments for chain saws, and more particularly for a chain saw attachment for planing and squaring logs or rough timbers into finished lumber.

Chain saws and other rough cut saws are frequently used to convert felled trees into rough cut lumber, and there are a great variety of saw guiding attachments for doing so. Rough cut lumber is acceptable for some applications, but is not generally acceptable for interior finishing or woodwork where the end product is to be viewed or handled. Such higher quality applications require a smoother surface on the lumber, which surface is typically produced by planing the lumber in a fixed planing machine, such as is normally found only in a lumber mill. There are many circumstances in which it may be impractical or prohibitively expensive to transport rough cut lumber to a planing machine, such as where the rough cut lumber is produced with a chain saw or is otherwise rough sawn at a remote construction project and is to be installed at the site.

2. Description of the Prior Art

My prior patent Gardner U.S. Pat. No. 4,479,303 discloses and claims a chain saw attachment for removing the bark from trees by means of dual cutting wheels each having four planing knives, the cutting wheels being driven by a sprocket positioned between the two wheels, the sprocket being driven by a conventional saw chain. Glover U.S. Pat. No. 4,304,275 discloses a chain saw attachment capable of roughly planing logs by means of a cylindrical drum having a conventional saw chain supported in a helical groove around the drum with the teeth of the chain extending outwardly so as to cut the bark and wood of the log.

SUMMARY OF THE INVENTION

It is an object of the present invention to provide a portable chain saw attachment for producing a high quality planed surface on a wooden workpiece.

It is a further object of this invention to provide a chain saw planer attachment including a planing guide having a precise depth of cut adjustment mechanism.

It is another object of this invention to provide a chain saw planer attachment which can be operated while holding the chain saw bar at any of various angles with respect to the cutting plane defined by the planing guide of the attachment.

It is yet another object of this invention to provide a chain saw planer attachment including a safety shield for protecting the operator from flying chips and other debris ejected by the planing knives of the attachment.

These and other objects are provided by a chain saw attachment for use with a portable chain saw having a saw bar, an endless chain disposed for movement around the saw bar, and a motor for moving the saw chain around the saw bar. The chain saw attachment comprises a cutter head having a plurality of planing knives, cutter axle means, two mounting arms, a chain sprocket, and power transmission means operatively connecting the chain sprocket to the cutter head. The planing knives are arranged generally equispatially around the cutter head and span substantially the entire length of the cutter head. The cutter head is journalled on the cutter axle means. The cutter axle means has end portions extending outwardly from the ends of the cutter head. The mounting arms are adapted to being removably mounted on the saw bar. The mounting arms receive the end portions of the cutter axle means so that the longitudinal axis of the cutter head is held substantially perpendicularly of the plane of the saw bar when the chain saw attachment is mounted thereon. The chain sprocket is positioned and shaped to engage and be rotated by the saw chain. The power transmission means operatively connects the chain sprocket and the cutter head so that the cutter head is rotated in response to rotation of the chain sprocket by the saw chain.

A planing guide is provided for optional use with the chain saw planer attachment. The planing guide has side members, forward and rearward guide members fixedly attached to and respectively positioned forwardly and rearwardly along the side members and defining a cutting plane, and guide mounting means for mounting the planing guide in relation to the cutter head so as to maintain the selected depth of cut. The planing guide preferably includes depth adjustment means for adjusting the distance between the cutter axle and the cutting plane so that the depth of cut of the planing knives is selectively adjustable.

Other features and advantages of the present invention will become apparent from the following detailed description of a typical embodiment thereof, taken in conjunction with the accompanying drawings.

DESCRIPTION OF THE PREFERRED EMBODIMENT

Figures 1, 2, 3:
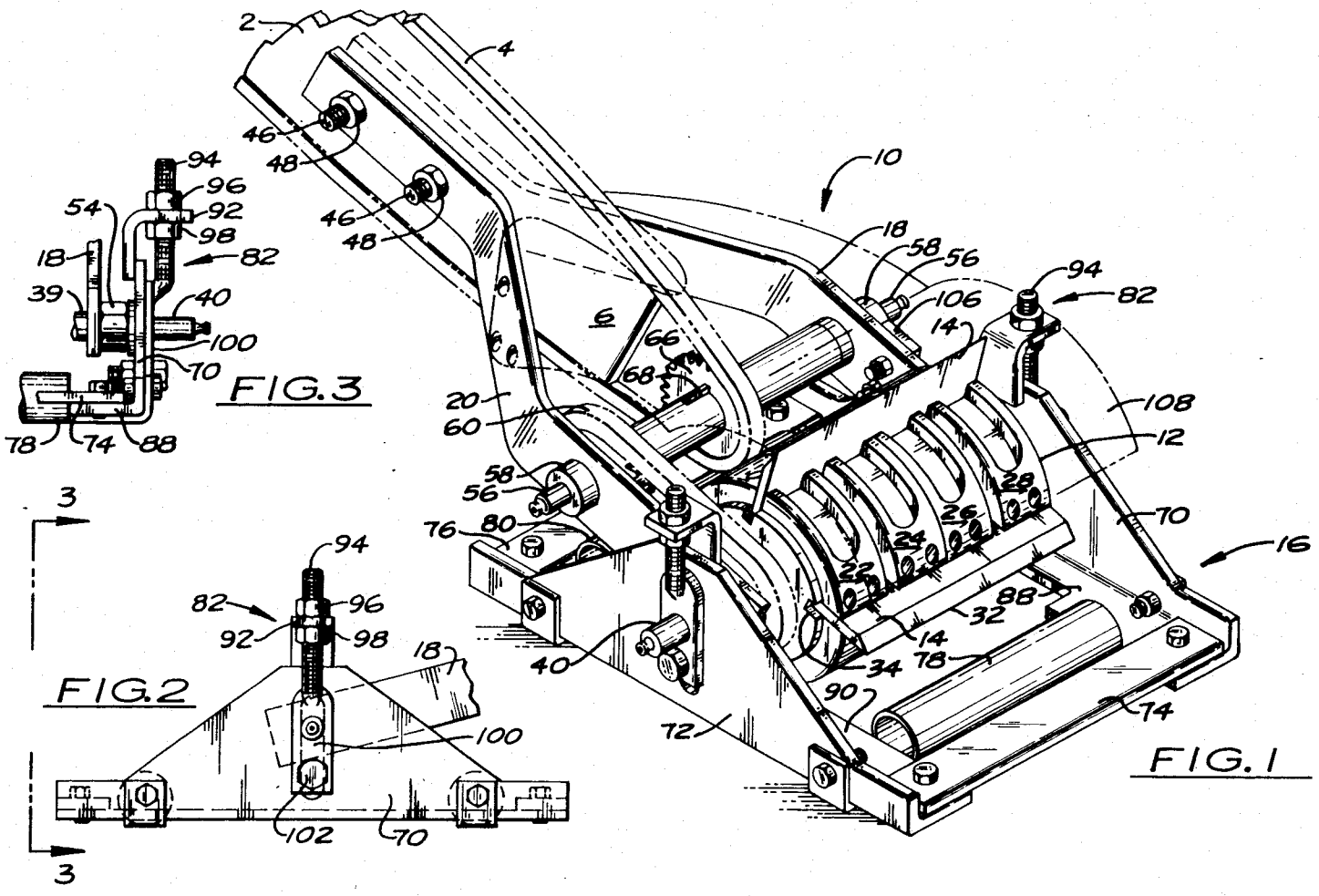
FIG. 1 is an isometric view of a chain saw planer attachment according to the present invention, showing particularly the mounting arms, the cutter head and planing knives, and the planing guide pivotably mounted on the cutter axle.
FIG. 2 is a side elevational view of a portion of the planing guide of FIG. 1, showing the depth of cut adjustment mechanism.
FIG. 3 is an end elevational view of the depth of cut adjustment mechanism taken along the line 3–3 of FIG. 2.
Figure 4:
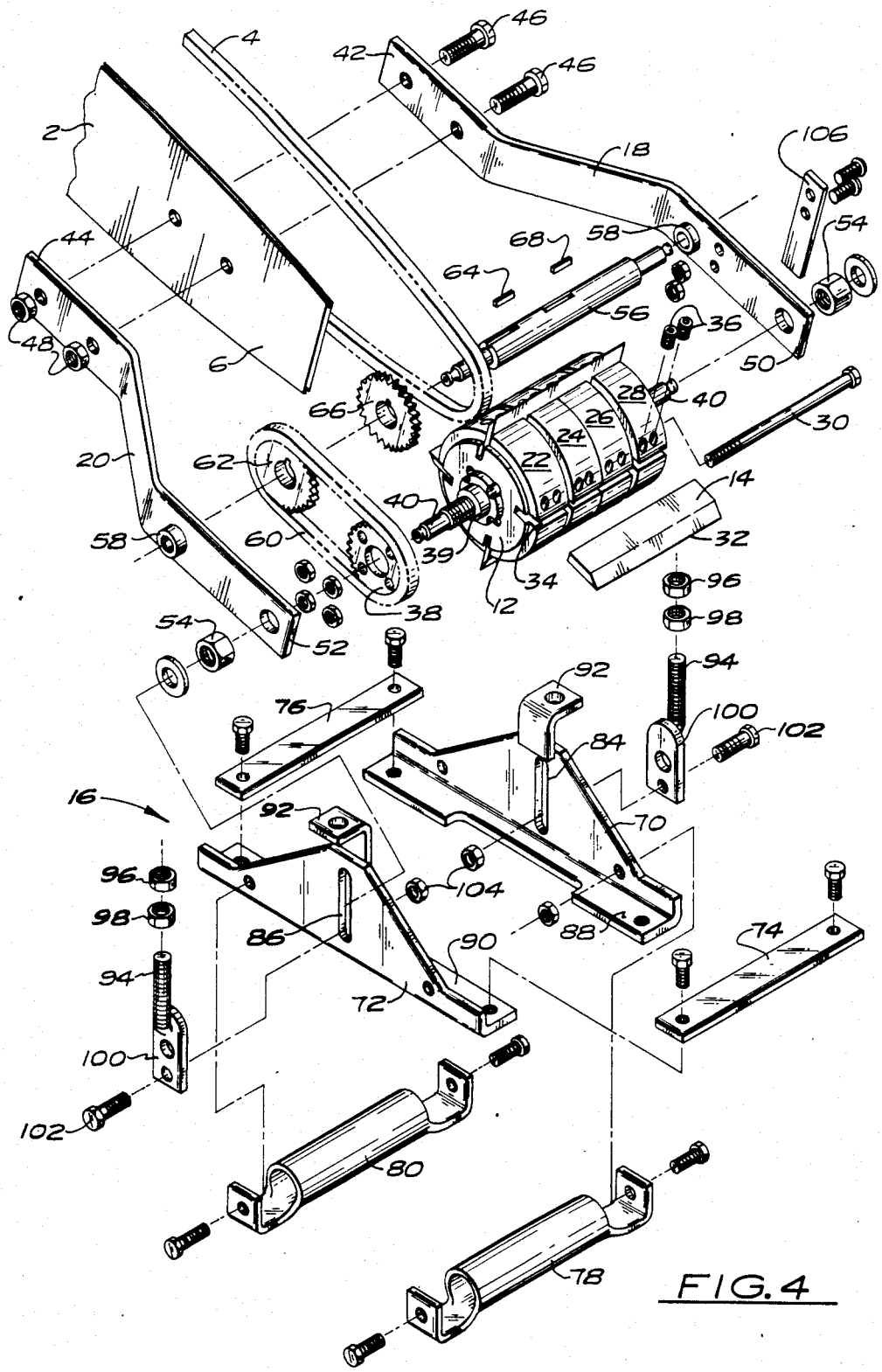
FIG. 4 is an exploded isometric view of the chain saw planer attachment of FIG. 1.

As seen in FIGS. 1 and 4, the chain saw planer attachment 10 of the present invention is adapted to be mounted on a conventional portable power-driven chain saw. The saw bar 2 extends outwardly from the saw motor (not shown) and has an endless saw chain 4 trained therearound. The saw chain 4 is driven in a conventional manner by the chain saw motor. The aforesaid parts of the chain saw are of conventional construction with the exception that the distal end 6 of the saw bar 2 is cut flatly to provide adequate safe clearance between the saw bar and the planer attachment 10. The saw chain 4 may be shortened or elongated as needed to adjust to the length of the saw bar 2 and the added planer attachment 10.

The planer attachment 10 comprises a generally cylindrical cutter head 12 holding a plurality of planing knives 14, a planing guide 16, and two mounting arms 18,20 for mounting the planer attachment on the saw bar 2 of the chain saw. The cutter head 12 comprises four cutter wheels 22,24,26,28 positioned adjacent to and coaxially with each other. The cutter wheels 22, 24,26,28 are held closely and securely together by four longitudinal bolts 30 so as to form the unitary assembly of the cutter head 12. The four planing knives 14 are disposed quadrantly around the circumference of the cutter head 12. The planing knives 14 are rectangular elements oriented with a longer dimension parallel to the axis of the cutter head 12, and extending outwardly therefrom to a bevelled cutting edge 32. The cutting edge 32 of each planing knife 14 is spaced outwardly from the outermost surface of the cutter head 12, and extends parallel to the longer dimension of the planing knife and thus to the longitudinal axis of the cutter head. The planing knives 14 do not extend radially outwardly from the cutter head 12, but rather are inclined so that the cutting edge 32 of each planing knife 14 leads the remainder of the planing knife with respect to the instantaneous direction of movement of such planing knife when the cutter head is rotated by the chain saw. The planing knives 14 are preferably about 0.16 inch (4.1 mm) thick, 1¼ inches wide and of a length substantially equal to the longitudinal dimension of the cutter head 12, and are preferably made of hardened steel. The planing knives 14 are placed in individual knife slots 34 machined into the body of the cutter head 12. Eight set screws 36 spaced substantially equidistantly along the length of each knife slot 34 hold the respective planing knife 14 of such knife slot therein, thereby allowing the knives to be individually removed for sharpening or replacement. The eight set screws 36 holding each planing knife 14 in place are disposed in pairs in each of the four cutter wheels 22,24,26,28.

A driven sprocket 38 is positioned coaxially with the cutter head 12, being fixedly attached to one of the circular ends of the cutter head by the four longitudinal bolts 30 joining the cutter wheels 22,24,26,28. The teeth of the driven sprocket 38 are spaced outwardly from the end surface of the cutter head 12 to provide adequate clearance between the teeth and the cutter head. The cutter head 12 and driven sprocket 38 are journalled on a bearing sleeve 39 disposed within axial apertures therethrough. A cutter axle 40 is fixedly attached to the bearing sleeve 39 within an axial opening therein. The cutter axle 40 includes threaded end portions extending axially outwardly beyond the bearing sleeve 39. The cutter axle 40 preferably includes one or more grease fittings and channels in the end portions thereof to allow lubrication of the bearing sleeve 39 supporting the cutter head 12 and driven sprocket 38 on the cutter axle.

The proximal ends 42,44 of the mounting arms 18,20 are removably attachable to opposite planar faces of the saw bar 2 by mounting bolts 46 and nuts 48. The mounting arms 18,20 extend outwardly from the saw bar 2 and receive the end portions of the cutter axle 40 so that the cutter axle is held substantially perpendicular with respect to the plane of the saw bar when the planer attachment 10 is mounted thereon. The mounting arms 18,20 are angled outwardly from the plane of the saw bar 2 such that the distal ends 50,52 thereof are separated by a distance sufficient to receive the bearing sleeve 39 and the cutter head 12 and driven sprocket 38 journalled thereon. Two cutter axle nuts 54 securely and immovably hold the distal ends 50,52 of the mounting arms 18,20 against the bearing sleeve 39 so that the mounting arms 18,20, the bearing sleeve 39 and the cutter axle 40 are joined together as a single assembly. The length of the bearing sleeve 39 is sufficient to provide suitable clearance between the mounting arms 18,20 and the cutter head 12 and driven sprocket 38.

A sprocket axle 56 is positioned between the cutter axle and the distal end 6 of the saw bar 2, oriented parallel to the cutter axle 40. The sprocket axle 56 is rotatably mounted between the mounting arms 18,20 by bushings 58 fixedly attached through the mounting arms, and preferably includes one or more grease fittings and channels in end portions thereof for lubricating such bushings. The driven sprocket 38 is driven by an endless planer chain 60 trained around and engaging the driven sprocket 38 and a driving sprocket 62. The driving sprocket 62 is aligned coplanarly with the driven sprocket 38 so that the planer chain 60 travels readily between the driving and driven sprockets. The driving sprocket 62 is fixedly and coaxially mounted on the sprocket axle 56 by means of a first key 64, so that the sprocket axle and the driving sprocket rotate in unison. The sprocket axle 56 and driving sprocket 62 are rotated by a chain sprocket 66 fixedly and coaxially mounted on the sprocket axle 60 by means of a second key 68. The chain sprocket 66 is aligned coplanarly with the saw bar 2 so that the saw chain 4 engages the teeth of the chain sprocket. Thus, rotation of the saw chain 4 around the saw bar 2 causes simultaneous rotation of the chain sprocket 66, which being fixedly mounted on the sprocket axle 56 causes rotation of such axle and of the driving sprocket 62. Such rotation of the driving sprocket 62 causes rotation of the planer chain 60 engaged thereby, which in turn engages and rotates the driven sprocket 38 and the cutter head 12 fixedly attached thereto.

The use of sprockets and chains to transmit power from the chain saw motor to the cutter head provides several advantages. First, appropriate sizing of the sprockets allows the cutter head 12 to be coupled to the saw chain 4 within a range of gear ratios, thus adapting the planer attachment 10 to operate upon materials of varying density and strength. Second, the position of the driven sprocket 38 at one end of the cutter head rather than between the cutter wheels 22,24,26,28 of the cutter head allows each planing knife 14 to make a continuous and uninterrupted cut into the workpiece along the entire length of the cutting edge 32 thereof. This is a distinct improvement over the chain saw attachment disclosed in my earlier U.S. Pat. No. 4,479,303, which relied on the teeth of the saw chain to cut the portion of the workpiece falling between the knives of the two cutter wheels. The four quadrantly disposed planing knives 14 of the present invention produces a smoothly planed surface not possible with the attachment of my earlier patent.

The planing guide 16 is provided to further improve the quality of the planed surface produced on the workpiece. The planing guide 16 is pivotably mounted on the cutter axle 40 between the opposed end portions thereof and the mounting arms 18,20. The planing guide 16 comprises first and second side members 70,72, first and second cross braces 74,76, forward and rearward transverse guide members 78,80, and a depth of cut adjustment mechanism 82. The side members 70,72 comprise substantially triangular metal plate elements oriented perpendicularly to the axis of the cutter head 12. Elongated vertical slots 84,86 in the side members 70,72 receive the end portions of the cutter axle 40 so as to mount the planing guide 16 on the cutter axle. An elongated flat projection 88,90 of each side member 70,72 is fixedly attached along the longest, lower edge of such side member perpendicularly thereto, and extends inwardly from such side member toward the opposite side member to provide additional structural strength and rigidity to the planing guide 16. The forward and rearward cross braces 74,76 are fixedly attached to the flat projections 88,90 of the side members 70,72 and extend rigidly therebetween to form the planing guide 16 as a single structural unit. The forward cross brace 74 extends substantially perpendicularly between the forwardmost end portions of the side members 70,72, while the rearward cross brace 76 extends substantially perpendicularly between the rearwardmost end portions of the side members.

The lowermost portions of the surfaces of the guide members 78,80 define a cutting plane above which wood is removed from the workpiece by the planing knives 14 to produce a smooth flat surface on the workpiece. The cutting plane defined by the forward and rearward guide members 78,80 is spaced perpendicularly from the cutter axle 12 by a distance which defines the depth of cut of the planing knives 14 into the workpiece.

The depth of cut is selected and maintained by the depth of cut adjustment mechanism 82. The depth of cut adjustment mechanism 82 comprises substantially identical assemblies on each of the side members 70,72, and therefore only the mechanism associated with the first side member 70 is described herein. The depth of cut adjustment mechanism associated with the second side member 72 is essentially merely a lateral mirror image of the mechanism associated with the first side member. As best seen in the detailed views of FIGS. 2 and 3, the depth of cut adjustment mechanism 82 comprises a right angled side extension 92, a threaded adjustment bolt 94 with suitable upper and lower lock nuts 96,98, and a connecting plate 100. The side extension 92 is fixedly attached to an uppermost portion of one of the side members 70 and extends vertically upwardly therefrom, and thence extends horizontally outwardly for a distance substantially equal to the distance extended upwardly from the side member. The adjustment bolt 94 is received in a hole in the horizontal portion of the side extension 92, and extends downwardly therefrom to the connecting plate 100. The upper lock nut 96 is threaded on an upper portion of the adjustment bolt above the horizontal portion of the side extension 92, while the lower lock nut is threaded on the adjustment bolt below such horizontal portion. The lock nuts 96,98 thus allow the adjustment bolt to be readily positioned vertically relative to the side extension 92, and thus relative to the side member 70 merely by threadably moving the lock nuts along the length of the bolt. The adjustment bolt 94 is fixed in place by threadably moving the lock nuts 96,98 toward each other until the horizontal portion of the side extension 92 is firmly secured between them.

The connecting plate 100 is an elongated flat substantially rectangular member positioned adjacent the outer vertical surface of the side member 70. A longer dimension of the connecting plate is oriented vertically so as to substantially cover the vertically elongated slot 84 in the side member. The width of the connecting plate 100 is substantially greater than the width of the elongated vertical slot 84 in the side member 70 so that the connecting plate extends beyond the slot to cover a portion of the side member. A lower end portion of the adjustment bolt 94 is fixedly attached to an upper end portion of the connecting plate 100. The hole in the horizontal portion of the side extension 92 is centered in a substantially vertical plane extending upwardly from the cutter axle 40 and oriented perpendicularly to the cutting plane defined by the guide members 78,80. The slot 84 in the side member 70 which receives the end of the cutter axle 40 thus also lies in such vertical plane, ensuring that the depth of cut is adjusted precisely perpendicularly to the cutting plane. A first upper hole extending perpendicularly through the connecting plate 100 along the longitudinal centerline thereof snugly receives the cutter axle 40 while allowing the cutter axle to rotate therein. A second lower hole in the connecting plate 100 receives a connecting bolt 102. The connecting bolt 102 extends from the outer exposed surface of the connecting plate 100 inwardly through the second lower hole thereof and through the elongated vertical slot 84 in the side member 70, and is fitted with a suitable nut 104. The connecting plate 100 and the cutter axle 40 and cutter head 12 mounted therethrough are thus adjustable perpendicularly to the cutting plane within a range determined by the vertical length of the elongated vertical slot 84 in the side member 70 and by the distance between the upper and lower holes in the connecting plate 100, and can be firmly yet removably secured to the side member 70 by means of the connecting bolt 102 and nut 104.

The depth of cut adjustment mechanism 82 is used to adjust the depth of cut of the planing knives 14 as follows. First the connecting bolt 102 and nut 104 are loosened to disengage the connecting plate 100 from the side member 70. The lock nuts 96,98 holding the adjustment bolt 94 in position relative to the side extension 92 are then loosened so that the adjustment bolt can be moved vertically relative to the side extension. The vertical position of the adjustment bolt 94, and thus of the connecting plate 100 and the cutter axle 40, is manually adjusted to produce the desired depth of cut of the planing knives 14. The lock nuts 96,98 are then tightened to maintain such desired position and resulting depth of cut, and the connecting bolt 100 and nut 102 are tightened to firmly secure the connecting plate 100 and cutter axle 40 relative to the side member 70 of the planing guide.

The chain saw planer attachment 10 of the present invention provides a precision portable planing machine suited to producing high quality planed lumber without the need for conventional fixed milling equipment typically found only in saw mills and lumber yards.

A further feature of the invention allows an operator to use the planer attachment 10 while holding the chain saw bar at various angles with respect to the cutting plane defined by the planing guide 16, without varying the depth of cut of the planing knives 14. This feature greatly increases the versatility and ease of use of the planer attachment 10. A vertical strut 106 depending downwardly from the first mounting arm 18 prevents the angle defined between the saw bar 2 and the cutting plane from falling below a preselected minimum. The strut 106 is fixedly attached to the first mounting arm 18 between the sprocket axle 56 and the cutter axle 40, and depends therefrom toward the flat projection 88 of the first side member 70. The length of the strut 106 and the angle formed between the strut and the first mounting arm 18 are such that the lower distal end of the strut engages the flat projection 88 when the minimum angle between the saw bar 2 and the cutting plane is reached.

A safety shield 108 is also provided to protect the operator from flying wood chips ejected from the workpiece by the cutter knives 14. The safety shield 108 is securely yet removably attached to the mounting arms 18,20 near the proximal ends 42,44 thereof, and extends therefrom upwardly and forwardly to cover the cutter head 14. The length of the shield 108 is such that a forwardmost distal edge thereof is substantially superposed above the forward guide member 78.

It will be understood that the planer attachment 10 of the present invention may be used with a conventional chain saw chain as illustrated, or with any appropriately sized conventional roller chain and associated drive sprocket on the saw motor output shaft, with the roller chain drive often being preferred for reasons of safety.

It will also be understood that the cutter head, illustrated as comprising the four cutter wheels 22,24, 26,28 can readily be fabricated as a single piece, machined from cylindrical stock of appropriate width to carry the planing knives 14 in like manner as shown.

It is contemplated that one of the main uses of this attachment is in the construction of log buildings. Logs can be debarked and corner joints cut with the debarking attachment disclosed in my prior U.S. Pat. No. 4,479,303, then the logs can be flattened on two sides using this planer attachment. Logs can be cut true to thickness, and any crookedness taken out of the logs by attaching boards on opposite sides of the log, with the edges of the boards used as depth guides for the planing guide of the planer attachment to ride on.

It will be appreciated that, although specific embodiments of the invention have been described herein for purposes of illustration, various modifications may be made without departing from the spirit and scope of the invention as defined by the claims.

I claim:

1. A chain saw attachment for a portable chain saw having a saw bar, an endless chain disposed for movement around the saw bar, and a motor for moving the saw chain around the saw bar, said chain saw attachment comprising:

(a) a cutter head having a plurality of planing knives arranged generally equispatially around the cutter head and spanning substantially the entire length of the cutter head;

(b) cutter axle means having end portions thereof extending outwardly from the cutter head, the cutter head being journalled on said cutter axle means;

(c) two mounting arms receiving the end portions of the cutter axle means, the mounting arms being adapted to being secured to the saw bar so that the longitudinal axis of the cutter head is held substantially perpendicularly of the plane of the saw bar;

(d) a chain sprocket positionable and shaped to receive and be engaged by the saw chain; and (e) power transmission means operatively connecting said chain sprocket and said cutter head for rotating the cutter head in response to rotation of the chain sprocket by the saw chain.

2. A chain saw attachment according to claim 1, further comprising:

(f) a planing guide having:

(i) two side members, (ii) a forward guide member fixedly attached to and positioned forwardly along the side members, (iii) a rearward guide member fixedly attached to and positioned rearwardly along the side members, the forward and rearward guide members of the planing guide defining a cutting plane spaced perpendicularly from the cutter axle by a distance defining a depth of cut of the planing knives, and (iv) guide mounting means for securely mounting the planing guide in relation to the cutter head so as to maintain the selected depth of cut.

3. A chain saw attachment according to claim 2, further comprising:

(g) depth adjustment means for adjusting the distance between the cutter axle and the cutting plane.

4. A chain saw attachment according to claim 2, wherein the planing guide is pivotably mounted on the cutter axle such that the planing guide can be rotated about the cutter axle so as to vary the angle between the longitudinal axis of the saw bar and the cutting plane without substantially varying the depth of cut.

5. A chain saw attachment for mounting on a portable chain saw having a saw bar, an endless chain disposed for movement around the saw bar, and a motor for moving the saw chain around the saw bar, the chain saw attachment comprising:

(a) a cylindrical cutter head having a plurality of planing knives extending outwardly therefrom and continuously spanning substantially the full length of the cutter head;

(b) a driven sprocket adjacent to and fixedly attached to the cutter head at one end thereof so as to rotate the cutter head in response to rotation of the driven sprocket;

(c) a cutter axle extending through the centers of the cutter head and the driven sprocket, the cutter head being journalled on said cutter axle, said cutter axle having end portions extending perpendicularly outwardly from the cutter head;

(d) first and second mounting arms receiving the end portions of the cutter axle, the mounting arms being adapted to being secured to the saw bar so that the cutter axle is held perpendicularly to the plane of the saw bar;

(e) a driving sprocket positioned between the driven sprocket and the saw bar coplanar with the driven sprocket;

(f) an endless chain operatively connecting the driving sprocket to the driven sprocket so as to rotate the driven sprocket in response to rotation of the driving sprocket;

(g) a chain sprocket positionable substantially coplanar with the saw bar and shaped to receive and engage the saw chain, the chain sprocket being operatively connected to the driving sprocket so as to rotate the driving sprocket in response to rotation of the chain sprocket by the saw chain; and (h) a sprocket axle extending through the driving sprocket and the chain sprocket, the driving sprocket and the chain sprocket being journalled on the sprocket axle, the ends of the sprocket axle being received by the mounting arms so that the sprocket axle is held perpendicularly to the plane of the saw bar when the planer attachment is mounted thereon.

6. A chain saw attachment according to claim 5, wherein the driven sprocket and the cutter head are journalled on a bearing sleeve fixedly attached around a portion of the cutter axle.

7. A chain saw attachment according to claim 5, further comprising:

(i) a planing guide having:

(i) first and second side members, each side member receiving an end portion of the cutter axle, (ii) a forward guide member fixedly attached to and extending between respective forward ends of the first and second side members, (iii) a rearward guide member fixedly attached to and extending between respective rearward ends of the first and second side members, the forward and rearward guide members defining a cutting plane normally spaced from the cutter axle by a selected distance, the distance between the cutter axle and the cutting plane defining a selected depth of cut, and (iv) depth adjustment means for adjusting the distance between the cutter axle and the cutting plane so as to selectively adjust the depth of cut of the planing knives.

8. A chain saw attachment according to claim 7, wherein the first and second side members of the planing guide pivotably receive the end portions of the cutter axle in slots formed in the first and second side members, the slots being elongated in a direction perpendicular to the cutting plane, and wherein the depth adjustment means includes means for adjusting the position of the cutter axle in the elongated slots so as to adjust the distance between the cutter axle and the cutting plane.

9. A chain saw attachment according to claim 8, wherein the slots in the first and second side members pivotably receive the end portions of the cutter axle so that the saw bar and the planing guide can be rotated about the cutter axle without varying the depth of cut.

10. A chain saw attachment according to claim 9, further including means for maintaining at least a selected minimum angle between the cutting plane and the longitudinal axis of the saw bar.

11. A chain saw attachment according to claim 6, further including a safety cover positionable above the cutter head, said safety cover being fixedly attachable to the mounting arms.

12. In combination with a chain saw having a saw motor, a saw bar extending outwardly from the saw motor, and a saw chain trained around the saw bar and movable around the saw bar by the saw motor, a chain saw attachment comprising:

(a) a cutter head having a plurality of planing knives arranged generally equispatially around the cutter head and spanning substantially the entire length of the cutter head;

(b) cutter axle means having end portions thereof extending outwardly from the cutter head, the cutter head being journalled on said cutter axle means;

(c) two mounting arms receiving the end portions of the cutter axle means, the mounting arms being adapted to being secured to the saw bar so that the axis of the cutter head is held substantially perpendicularly of the plane of the saw bar;

(d) a chain sprocket positionable substantially coplanar with the saw bar and shaped to receive and engage the saw chain;

(e) power transmission means operatively connecting said chain sprocket and said cutter head for rotating the cutter head in response to rotation of the chain sprocket by the saw chain; and (f) a planing guide having two side members, forward and rearward guide members attached to and respectively positioned forwardly and rearwardly along the side members so as to define a cutting plane normally spaced from the cutter axle by a selected distance determining a depth of cut of the planing knives, guide mounting means for securely mounting the planing guide in relation to the cutter head so as to maintain the selected depth of cut, and depth adjustment means for adjusting the distance between the cutter axle means and the cutting plane.

13. A combination according to claim 12, wherein the cutter head has four planing knives arranged quadrantly around the surface of the cutter head.

14. A combination according to claim 12, wherein the side members of the planing guide pivotably receive the end portions of the cutter axle means in slots formed therein, the slots being elongated in a direction substantially perpendicular to the cutting plane, and wherein the depth adjustment means includes means for adjusting the position of the cutter axle means in the elongated slots of the side members so as to adjust the depth of cut.

15. A combination according to claim 12, wherein the end portions of the cutter axle means are pivotably received in the slots in the side members so that the planing guide can be rotated with respect to the cutter axle means so as to vary the angle between the longitudinal axis of the saw bar and the cutting plane without varying the depth of cut.

16. A combination according to claim 12, wherein the chain saw attachment further comprises a safety cover positionable above the cutter head, said safety cover being fixedly attachable to the mounting arms.

* * * * *